US009511300B1

(12) United States Patent
Huron

(10) Patent No.: US 9,511,300 B1
(45) Date of Patent: Dec. 6, 2016

(54) MOTION SIMULATION SYSTEM

(71) Applicant: Steven Huron, Boeme, TX (US)

(72) Inventor: Steven Huron, Boeme, TX (US)

( * ) Notice: Subject to any disclaimer, the term of this patent is extended or adjusted under 35 U.S.C. 154(b) by 0 days.

(21) Appl. No.: 15/069,309

(22) Filed: Mar. 14, 2016

(51) Int. Cl.
*A63G 31/16* (2006.01)
*A47C 3/02* (2006.01)

(52) U.S. Cl.
CPC ..... *A63G 31/16* (2013.01)

(58) Field of Classification Search
CPC ..... A63G 31/00; A63G 31/02; A63G 31/16; A47C 1/00; A47C 3/02; A47C 3/0255; A63J 5/00; A63J 5/12
USPC ..... 472/59, 60, 61, 95–97, 130; 434/29, 55
See application file for complete search history.

(56) References Cited

U.S. PATENT DOCUMENTS

D321,449 S 11/1991 Meeker
5,533,933 A * 7/1996 Garnjost ..... G09B 9/12 472/130
5,772,513 A * 6/1998 Ohishi ..... A63F 13/08 434/55
5,791,903 A * 8/1998 Feuer ..... G09B 9/14 434/30
6,371,853 B1 * 4/2002 Borta ..... A63F 7/386 273/118 A
6,793,495 B2 * 9/2004 Kang ..... A63F 13/08 434/55
7,703,848 B1 4/2010 Cochran et al.
7,814,587 B2 10/2010 Thomas
7,845,722 B1 12/2010 Manenti et al.
7,918,505 B2 4/2011 Raphael et al.
8,047,888 B1 11/2011 Seymore

FOREIGN PATENT DOCUMENTS

WO WO2009094013 7/2009
WO 20120124832 3/2012

* cited by examiner

*Primary Examiner* — Kien Nguyen

(57) ABSTRACT

A motion simulation system includes a pedestal that may be positioned on a support surface. A car seat is coupled to the top wall and the car seat may support a child. A tilting unit is positioned within the pedestal and the tilting unit is mechanically coupled to the car seat. The tilting unit selectively urges the car seat to tilt in a plurality of angles with respect to a longitudinal axis extending through the pedestal. Thus, the tilting unit simulates motions associated with riding in a vehicle thereby facilitating the tilting unit to soothe the child. A control unit is coupled to the pedestal and the control unit is electrically coupled to the tilting unit.

13 Claims, 5 Drawing Sheets

MOTION SIMULATION SYSTEM

BACKGROUND OF THE DISCLOSURE

Field of the Disclosure

The disclosure relates to simulation devices and more particularly pertains to a new simulation device for soothing a child to sleep.

SUMMARY OF THE DISCLOSURE

An embodiment of the disclosure meets the needs presented above by generally comprising a pedestal that may be positioned on a support surface. A car seat is coupled to the top wall and the car seat may support a child. A tilting unit is positioned within the pedestal and the tilting unit is mechanically coupled to the car seat. The tilting unit selectively urges the car seat to tilt in a plurality of angles with respect to a longitudinal axis extending through the pedestal. Thus, the tilting unit simulates motions associated with riding in a vehicle thereby facilitating the tilting unit to soothe the child. A control unit is coupled to the pedestal and the control unit is electrically coupled to the tilting unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
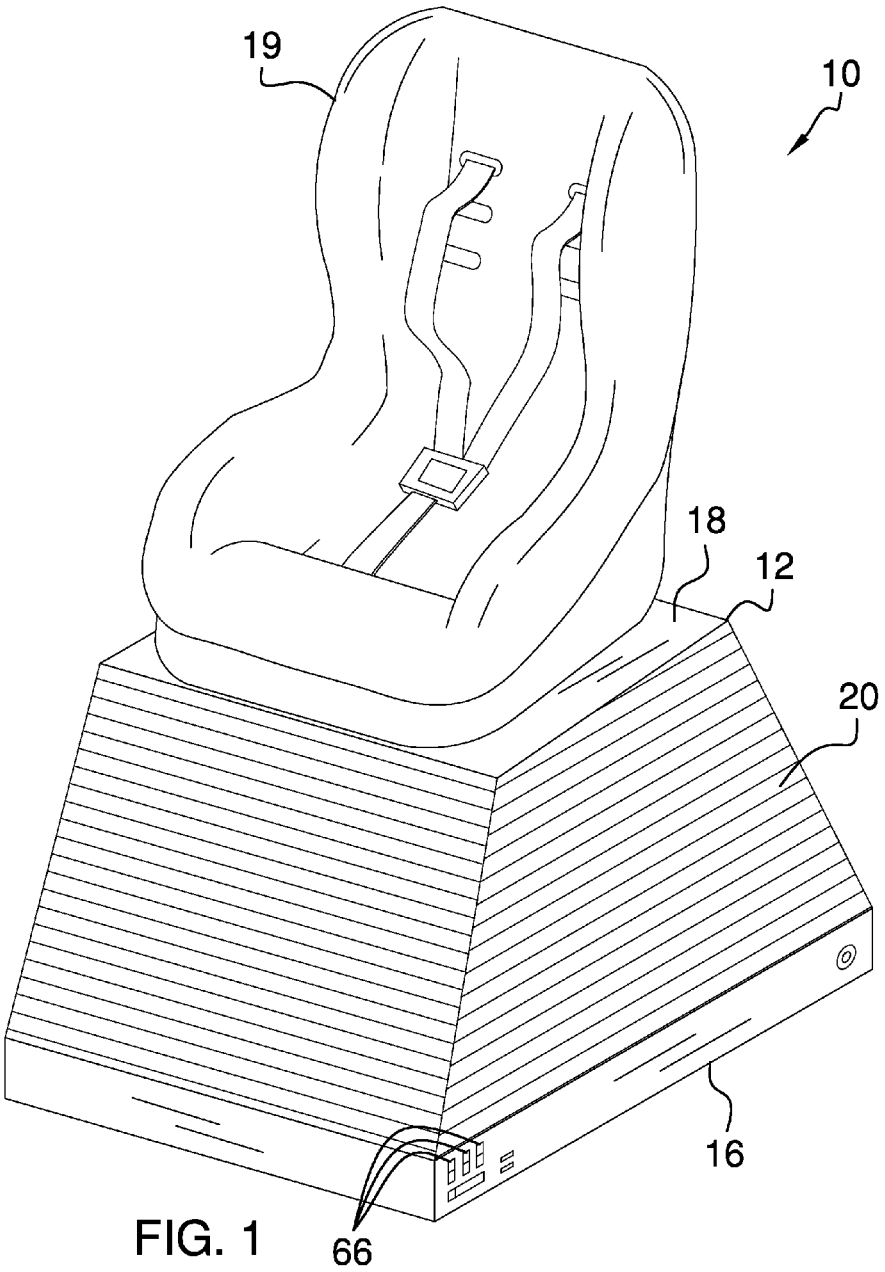
FIG. 1 is a perspective view of a motion simulation system according to an embodiment of the disclosure.
Figure 2:
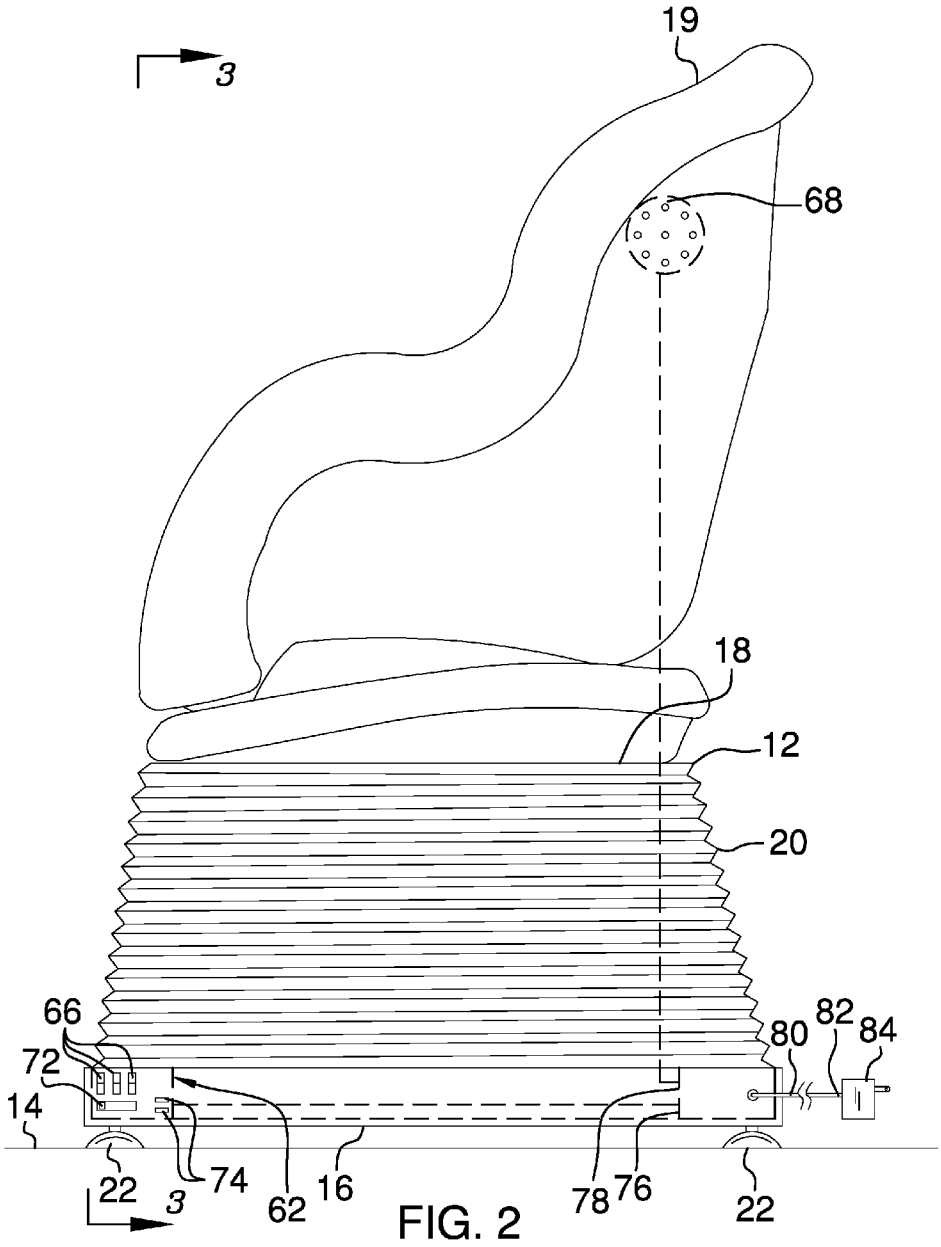
FIG. 2 is a left side view of an embodiment of the disclosure.
Figure 3:
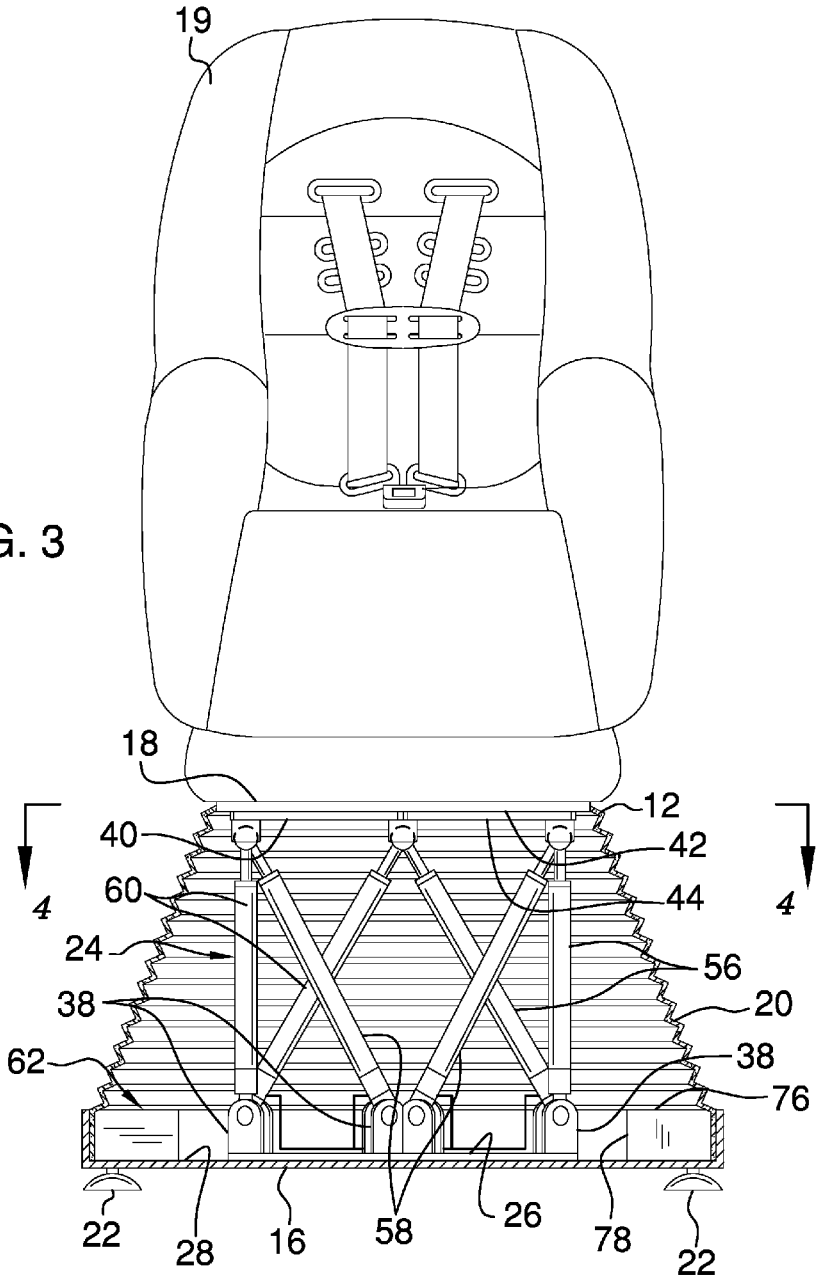
FIG. 3 is a cross sectional view taken along line 3-3 of FIG. 2 of an embodiment of the disclosure.
Figure 4:
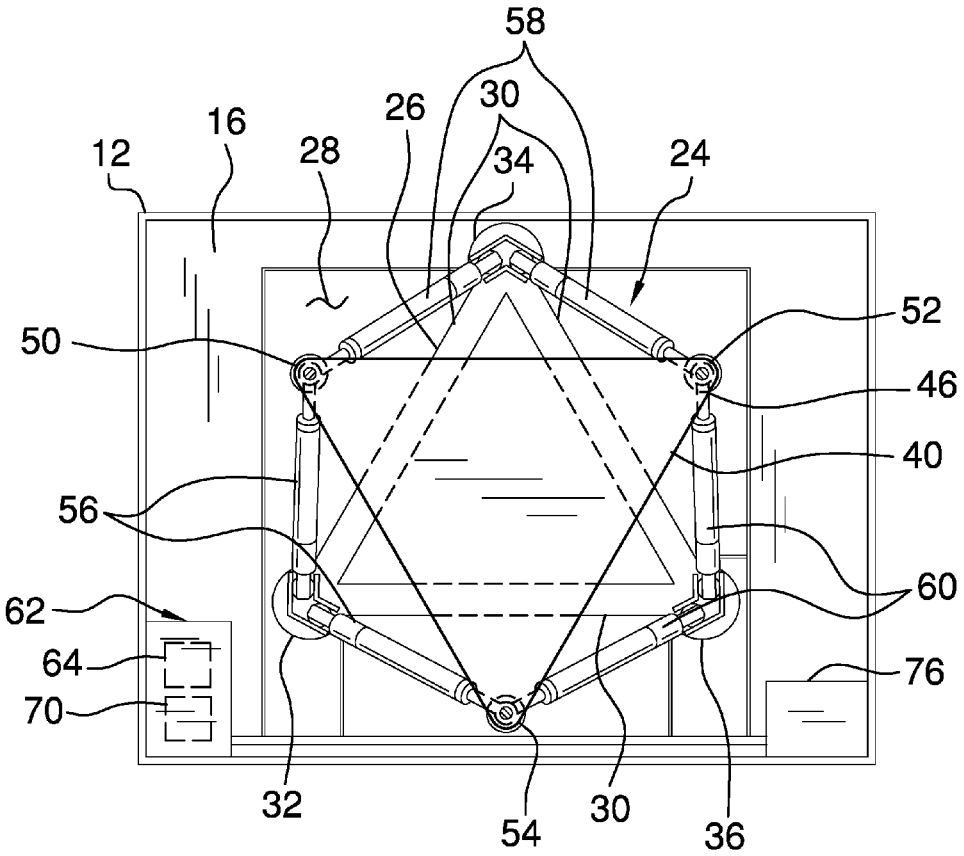
FIG. 4 is a cross sectional view taken along line 4-4 of FIG. 3 of an embodiment of the disclosure.
Figure 5:
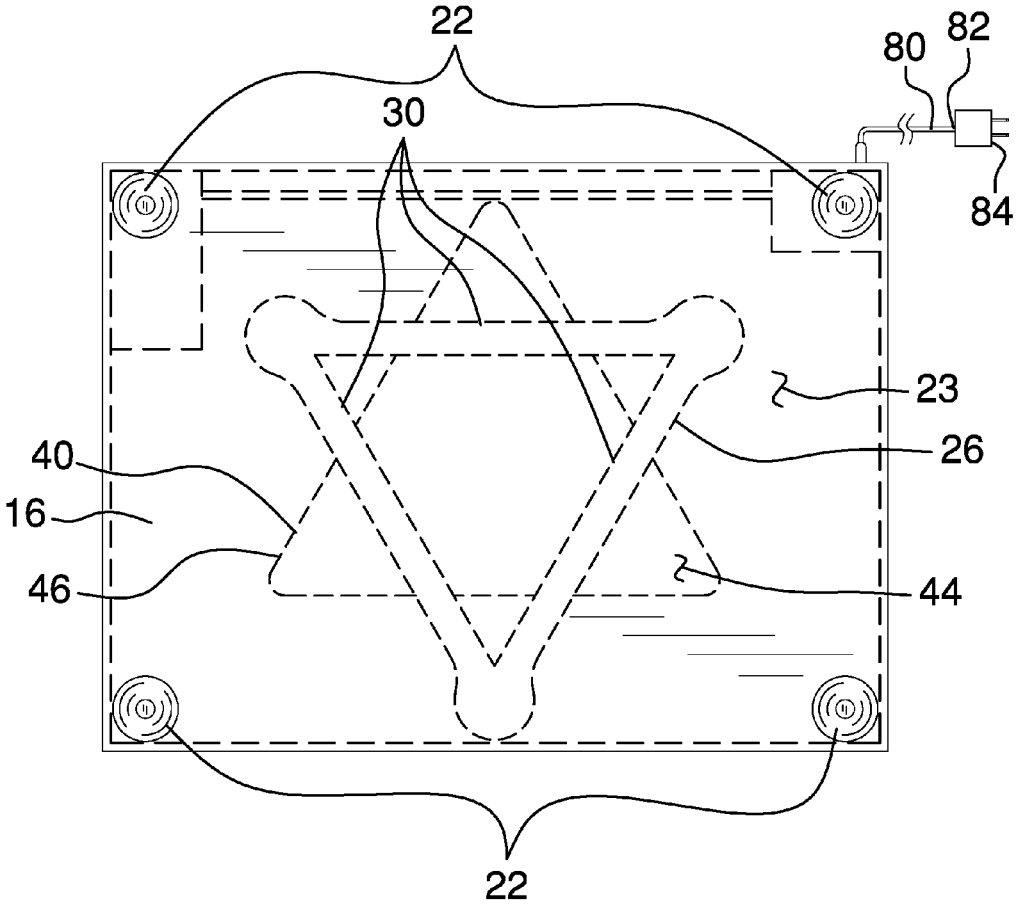
FIG. 5 is a bottom phantom view of an embodiment of the disclosure.

With reference now to the drawings, and in particular to FIGS. 1 through 5 thereof, a new simulation device embodying the principles and concepts of an embodiment of the disclosure and generally designated by the reference numeral 10 will be described.

As best illustrated in FIGS. 1 through 5, the motion simulation system 10 generally comprises a pedestal 12 that may be positioned on a support surface 14. The support surface 14 may be a floor or the like. The pedestal 12 has a bottom wall 16, a top wall 18 and a peripheral wall 20 extending between the top wall 18 and the bottom wall 16. The peripheral wall 20 is pleated between the top wall 18 and the bottom wall 16. Thus, the top wall 18 is selectively movable with respect to the bottom wall 16. A car seat 19 is coupled to the top wall 18 and the car seat 19 may support a child. The car seat 19 may comprise a child car seat of any conventional design.

A plurality of suction cups 22 is provided. Each of the suction cups 22 is coupled to a bottom surface 23 of the bottom wall 16. The suction cups 22 are spaced apart from each other and distributed on the bottom wall 16. Each of the suction cups 22 suctionally engages the support surface 14. Thus, the pedestal 12 is inhibited from sliding on the support surface 14.

A tilting unit 24 is positioned within the pedestal 12. The tilting unit 24 is mechanically coupled to the car seat 19. The tilting unit 24 selectively urges the car seat 19 to move in a plurality of directions with respect to a longitudinal axis extending vertically through the pedestal 12. The tilting unit 24 selectively urges the car seat 19 to travel upwardly, downwardly, and perpendicular to the longitudinal axis.

The tilting unit 24 may urge the car seat 19 to substantially rotate about a lateral axis extending horizontally through the pedestal 12. Additionally, the tilting unit 24 may urge the car seat 19 to substantially rotate about the longitudinal axis. Thus, the tilting unit 24 simulates motions associated with riding in a vehicle thereby facilitating the tilting unit 24 to soothe the child. The tilting unit 24 may comprise a six axis hydraulic actuator or the like.

The tilting unit 24 comprises a frame 26 that is coupled to a top surface 28 of the bottom wall 16. The frame 26 has a plurality of arms 30. Each of the arms 30 intersects with each other such that the frame 26 has a triangular shape. The triangular shape has a first point 32, a second point 34 and a third point 36. Each of the first point 32, the second point 34 and the third point 36 may be rounded. The frame 26 includes a plurality of mounts 38 and each of the mounts 38 is coupled to and extends upwardly from the frame 26. Each of the mounts 38 is positioned on an associated one of the first point 32, the second point 34 and the third point 36.

A plate 40 is coupled to a bottom surface 42 of the top wall 18. The plate 40 has a bottom surface 44 and a peripheral edge 46. The peripheral edge 46 has a plurality of intersecting sides 48 such that the plate 40 has a triangular shape. The triangular shape corresponding to the plate 40 has a primary point 50, a secondary point 52 and a tertiary point 54. Each of the frame 26 and the plate 40 are centrally positioned on the pedestal 12. The plate 40 is oriented to be offset ninety degrees of rotation on the longitudinal axis with respect to the frame 26.

A first pair of pistons 56 is provided and each of the first pair of pistons 56 extends between the frame 26 and the plate 40. Each of the first pair of pistons 56 is movably coupled to the mount 38 corresponding to the first point 32. Each of the first pair of pistons 56 is movably coupled to an associated one of the primary point 50 and the tertiary point 54. Each of the first pair of pistons 56 urges the plate 40 to tilt about the longitudinal axis.

A second pair of pistons 58 is provided and each of the second pair of pistons 58 extends between the frame 26 and the plate 40. Each of the second pair of pistons 58 is movably coupled to the mount 38 corresponding to the second point 34. Each of the second pair of pistons 58 is movably coupled to an associated one of the primary point 50 and the secondary point 52. Each of the second pair of pistons 58 urges the plate 40 to tilt about the longitudinal axis.

A third pair of pistons 60 is provided and each of the third pair of pistons 60 extends between the frame 26 and the plate 40. Each of the third pair of pistons 60 is movably coupled to the mount 38 corresponding to the third point 36. Each of the third pair of pistons 60 is movably coupled to an associated one of the secondary point 52 and the tertiary point 54. Each of the third pair of pistons 60 urges the plate 40 to tilt about the longitudinal axis. Each of the first pair of pistons 56, the second pair of pistons 58 and the third pair of pistons 60 may comprise an electrically controlled, linear actuator or the like.

A control unit 62 is coupled to the pedestal 12. The control unit 62 is electrically coupled to the tilting unit 24. Thus, the control unit 62 actuates the tilting unit 24 to tilt the car seat 19 in the plurality of angles, upwardly, downwardly and laterally. The control unit 62 comprises a processor 64 that is coupled to the pedestal 12. The processor 64 may comprise an electronic processor or the like. The processor 64 is electrically coupled to each of the first pair of pistons 56, the second pair of pistons 58 and the third pair of pistons 60. The processor 64 selectively actuates each of the first pair of pistons 56, the second pair of pistons 58 and the third pair of pistons 60 to tilt the plate 40 in a random sequence of angles with respect to the longitudinal axis. Additionally, the processor 64 selectively actuates each of the first pistons 56, the second pair of pistons 58 and the third pair of pistons 60 to lift the plate 40, lower the plate 40 and urge the plate 40 laterally with respect to the longitudinal axis.

A plurality of switches 66 is provided. Each of the switches 66 is coupled to the peripheral wall 20 of the pedestal 12 and each of the switches 66 may be manipulated. Each of the switches 66 is electrically coupled to the processor 64. Each of the switches 66 controls operational parameters of the tilting unit 24.

A speaker 68 is coupled to the car seat 19. The speaker 68 emits audible sounds mimicking sounds associated with vehicular travel. Thus, the speaker 68 may soothe the child. The speaker 68 is electrically coupled to the processor 64. The processor 64 includes an electronic memory 70. The electronic memory 70 stores an audio file pertaining to the vehicular travel sounds. The electronic memory 70 additionally stores data pertaining to actuating the tilting unit 24.

A volume button 72 is movably coupled to the peripheral wall 20 and the volume button 72 may be manipulated. The volume button 72 is electrically coupled to the processor 64 and the volume button 72 adjusts a volume of the speaker 68. A pair of ports 74 is each coupled to the peripheral wall 20. Each of the ports 74 may be electrically coupled to an extrinsic electronic device and each of the ports 74 is electrically coupled to the processor 64. The ports 74 may download data into the electronic memory 70.

A power supply 76 is coupled to the pedestal 12 and the power supply 76 is electrically coupled to the processor 64. The power supply 76 comprises at least one rechargeable battery 78. The power supply 76 further comprises a cord 80 extending outwardly from the peripheral wall 20. The cord 80 is electrically coupled to the rechargeable battery 78 and the cord 80 has a distal end 82 with respect to the peripheral wall 20. A plug 84 is electrically coupled to the distal end 82. The plug 84 may be electrically coupled to a power source thereby facilitating the rechargeable battery 78 to be recharged.

In use, the pedestal 12 is positioned on the support surface 14 and the child is positioned in the car seat 19. The switches 66 are manipulated to control the operational parameters of the tilting unit 24. The volume button 72 is manipulated to adjust the volume of the speaker 68. The tilting unit 24 tilts the car seat 19 in a random sequence of angles to mimic the motions associated with riding in a vehicle. Thus, the child is soothed to sleep. The speaker 68 additionally emits the sounds associated with traveling in the vehicle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motion simulation system comprising:

a pedestal being configured to be positioned on a support surface, said pedestal having a bottom wall, a top wall and a peripheral wall extending between said top wall and said bottom wall, said peripheral wall being pleated such that said top wall is selectively movable with respect to said bottom wall;

a car seat being coupled to said top wall wherein said car seat is configured to support a child;

a tilting unit being positioned within said pedestal, said tilting unit being mechanically coupled to said car seat, said tilting unit selectively urging said car seat to move in a plurality of directions with respect to a longitudinal axis extending through said pedestal wherein said tilting unit is configured to simulate motions associated with riding in a vehicle thereby facilitating said tilting unit to soothe the child; and a control unit being coupled to said pedestal, said control unit being electrically coupled to said tilting unit such that said control actuates said tilting unit to tilt the car seat in the plurality of angles.

2. The assembly according to claim 1, wherein said tilting unit comprises a frame being coupled to a top surface of said bottom wall, said frame having a plurality of arms, each of said arms intersecting with each other such that said frame has a triangular shape having a first point, a second point and a third point, said frame including a plurality of mounts, each of said mounts being coupled to and extending upwardly from said frame, each of said mounts being positioned on an associated one of said first point, said second point and said third point.

3. The assembly according to claim 2, wherein said tilting unit further comprises a plate being coupled to a bottom surface of said top wall, said plate having a bottom surface and a peripheral edge, said peripheral edge having a plurality of intersecting sides such that said plate has a triangular shape having a primary point, a secondary point and a tertiary point, each of said frame and said plate being centrally positioned on said pedestal, said plate being oriented to be offset ninety degrees of rotation on said longitudinal axis with respect to said frame.

4. The assembly according to claim 3, further comprising a first pair of pistons, each of said first pair of pistons extending between said frame and said plate, each of said first pair of pistons being movably coupled to said mount corresponding to said first point, each of said first pair of pistons being movably coupled to an associated one of said primary point and said tertiary point, each of said first pair of pistons urging said plate to tilt about the longitudinal axis.

5. The assembly according to claim 3, further comprising a second pair of pistons, each of said second pair of pistons extending between said frame and said plate, each of said second pair of pistons being movably coupled to said mount corresponding to said second point, each of said second pair of pistons being movably coupled to an associated one of said primary point and said secondary point, each of said second pair of pistons urging said plate to tilt about the longitudinal axis.

6. The assembly according to claim 3, further comprising a third pair of pistons, each of said third pair of pistons extending between said frame and said plate, each of said third pair of pistons being movably coupled to said mount corresponding to said third point, each of said third pair of pistons being movably coupled to an associated one of said secondary point and said tertiary point, each of said third pair of pistons urging said plate to tilt about the longitudinal axis.

7. The assembly according to claim 1, wherein:

said tilting unit comprises a first pair of pistons, a second pair of pistons, a third pair of pistons and a plate; and said control unit comprises a processor being coupled to said pedestal, said processor being electrically coupled to each of said first pair of pistons, said second pair of pistons and said third pair of pistons, said processor selectively actuating each of said first pair of pistons, said second pair of pistons and said third pair of pistons to tilt said plate in a random sequence of angles with respect to said longitudinal axis.

8. The assembly according to claim 1, further comprising:

a processor; and a plurality of switches, each of said switches being coupled to said peripheral wall wherein each of said switches is configured to be manipulated, each of said switches being electrically coupled to said processor such that each of said switches controls operational parameters of said tilting unit.

9. The assembly according to claim 1, further comprising:

a processor; and a speaker being coupled to said car seat wherein said speaker is configured to emit audible sounds mimicking sounds associated with vehicular travel thereby facilitating said speaker to soothe the child, said speaker being electrically coupled to said processor.

10. The assembly according to claim 9, further comprising a volume button being movably coupled to said peripheral wall wherein said volume button is configured to be manipulated, said volume button being electrically coupled to said processor such that said volume button adjusts a volume of said speaker.

11. The assembly according to claim 1, further comprising:

a processor; and a pair of ports, each of said ports being coupled to said peripheral wall wherein each of said ports is configured to be electrically coupled to an extrinsic electronic device, each of said ports being electrically coupled to said processor.

12. The assembly according to claim 1, further comprising:

a processor; and a power supply being coupled to said pedestal, said power supply being electrically coupled to said processor, said power supply comprising at least one rechargeable battery, said power supply further comprising a cord extending outwardly from said peripheral wall, said cord being electrically coupled to said rechargeable battery, said cord having a distal end with respect to said peripheral wall, said distal end having a plug being electrically coupled thereto, said plug being configured to be electrically coupled to a power source thereby facilitating said rechargeable battery to be recharged.

13. A motion simulation system comprising:

a pedestal being configured to be positioned on a support surface, said pedestal having a bottom wall, a top wall and a peripheral wall extending between said top wall and said bottom wall, said peripheral wall being pleated such that said top wall is selectively movable with respect to said bottom wall;

a car seat being coupled to said top wall wherein said car seat is configured to support a child;

a tilting unit being positioned within said pedestal, said tilting unit being mechanically coupled to said car seat, said tilting unit selectively urging said car seat to move in a plurality of directions with respect to a longitudinal axis extending through said pedestal wherein said tilting unit is configured to simulate motions associated with riding in a vehicle thereby facilitating said tilting unit to soothe the child, said tilting unit comprising:

a frame being coupled to a top surface of said bottom wall, said frame having a plurality of arms, each of said arms intersecting with each other such that said frame has a triangular shape having a first point, a second point and a third point, said frame including a plurality of mounts, each of said mounts being coupled to and extending upwardly from said frame, each of said mounts being positioned on an associated one of said first point, said second point and said third point, a plate being coupled to a bottom surface of said top wall, said plate having a bottom surface and a peripheral edge, said peripheral edge having a plurality of intersecting sides such that said plate has a triangular shape having a primary point, a secondary point and a tertiary point, each of said frame and said plate being centrally positioned on said pedestal, said plate being oriented to be offset ninety degrees of rotation on said longitudinal axis with respect to said frame, a first pair of pistons, each of said first pair of pistons extending between said frame and said plate, each of said first pair of pistons being movably coupled to said mount corresponding to said first point, each of said first pair of pistons being movably coupled to an associated one of said primary point and said tertiary point, each of said first pair of pistons urging said plate to tilt about the longitudinal axis, a second pair of pistons, each of said second pair of pistons extending between said frame and said plate, each of said second pair of pistons being movably coupled to said mount corresponding to said second point, each of said second pair of pistons being movably coupled to an associated one of said primary point and said secondary point, each of said second pair of pistons urging said plate to tilt about the longitudinal axis, a third pair of pistons, each of said third pair of pistons extending between said frame and said plate, each of said third pair of pistons being movably coupled to said mount corresponding to said third point, each of said third pair of pistons being movably coupled to an associated one of said secondary point and said tertiary point, each of said third pair of pistons urging said plate to tilt about the longitudinal axis, and a control unit being coupled to said pedestal, said control unit being electrically coupled to said tilting unit such that said control actuates said tilting unit to tilt the car seat in the plurality of angles, said control unit comprising:

a processor being coupled to said pedestal, said processor being electrically coupled to each of said first pair of pistons, said second pair of pistons and said third pair of pistons, said processor selectively actuating each of said first pair of pistons, said second pair of pistons and said third pair of pistons to tilt said plate in a random sequence of angles with respect to said longitudinal axis, a plurality of switches, each of said switches being coupled to said peripheral wall wherein each of said switches is configured to be manipulated, each of said switches being electrically coupled to said processor such that each of said switches controls operational parameters of said tilting unit, a speaker being coupled to said car seat wherein said speaker is configured to emit audible sounds mimicking sounds associated with vehicular travel thereby facilitating said speaker to soothe the child, said speaker being electrically coupled to said processor, a volume button being movably coupled to said peripheral wall wherein said volume button is configured to be manipulated, said volume button being electrically coupled to said processor such that said volume button adjusts a volume of said speaker, a pair of ports, each of said ports being coupled to said peripheral wall wherein each of said ports is configured to be electrically coupled to an extrinsic electronic device, each of said ports being electrically coupled to said processor, and a power supply being coupled to said pedestal, said power supply being electrically coupled to said processor, said power supply comprising at least one rechargeable battery, said power supply further comprising a cord extending outwardly from said peripheral wall, said cord being electrically coupled to said rechargeable battery, said cord having a distal end with respect to said peripheral wall, said distal end having a plug being electrically coupled thereto, said plug being configured to be electrically coupled to a power source thereby facilitating said rechargeable battery to be recharged.

* * * * *